US010549143B2

(12) United States Patent
Chung

(10) Patent No.: US 10,549,143 B2
(45) Date of Patent: Feb. 4, 2020

(54) LARGE MUSCLE EXERCISE MACHINE

(71) Applicant: Chadwyck T Chung, Ooltewah, TN (US)

(72) Inventor: Chadwyck T Chung, Ooltewah, TN (US)

( * ) Notice: Subject to any disclaimer, the term of this patent is extended or adjusted under 35 U.S.C. 154(b) by 119 days.

(21) Appl. No.: 16/003,094

(22) Filed: Jun. 7, 2018

(65) Prior Publication Data

US 2018/0353798 A1 Dec. 13, 2018

Related U.S. Application Data

(60) Provisional application No. 62/516,216, filed on Jun. 7, 2017.

(51) Int. Cl.

| | |
|---|---|
| ***A63B 21/00*** | (2006.01) |
| ***A63B 71/00*** | (2006.01) |
| ***A63B 21/012*** | (2006.01) |
| ***A63B 1/00*** | (2006.01) |

(52) U.S. Cl.

CPC ..... *A63B 21/4035* (2015.10); *A63B 1/00* (2013.01); *A63B 21/00069* (2013.01); *A63B 21/012* (2013.01); *A63B 21/4029* (2015.10); *A63B 71/0036* (2013.01); *A63B 2225/093* (2013.01)

(58) Field of Classification Search

CPC ..... A63B 21/4035; A63B 1/00; A63B 21/012; A63B 71/0036; A63B 21/00069; A63B 21/4029; A63B 2225/093

See application file for complete search history.

(56) References Cited

U.S. PATENT DOCUMENTS

| | | | | |
|---|---|---|---|---|
| 4,768,775 A * | 9/1988 | Marshall | A63B 22/0076 | 482/133 |
| 5,569,130 A * | 10/1996 | Wang | A63B 22/0076 | 482/51 |
| 6,004,248 A * | 12/1999 | Price | A63B 21/055 | 482/121 |
| 7,070,548 B2 * | 7/2006 | Thonn, Jr. | A63B 21/00072 | 482/137 |
| 7,104,933 B1 * | 9/2006 | Liao | A63B 21/012 | 482/114 |

(Continued)

*Primary Examiner* — Garrett K Atkinson

(57) ABSTRACT

A large muscle exercise machine utilizes resistance to increase the effectiveness for a plurality of exercises performed by the user. The large muscle exercise machine includes a base frame, a support platform, a telescoping handlebar support, a handlebar, a first handle, a second handle, a first compression-adjustment mechanism, and a second compression-adjustment mechanism. The support platform is slideably engaged along the base frame to allow the user to position the support platform along the base frame. The telescoping handlebar support supports the handlebar. The first handle is rotatably mounted to the handlebar through the first compression-adjustment mechanism. Similarly, the second handle is rotatably mounted to the handlebar through the second compression-adjustment mechanism. The first compression-adjustment mechanism allows the user to adjust the resistance to rotation for the first handle. The second compression-adjustment mechanism allows the user to adjust the resistance to rotation for the second handle for the desired exercise.

18 Claims, 12 Drawing Sheets

(56) References Cited

U.S. PATENT DOCUMENTS

| | | | | |
|---|---|---|---|---|
| 7,361,124 | B1 * | 4/2008 | Chung-Ting | A63B 21/015 482/117 |
| 7,955,231 | B1 * | 6/2011 | Chen | A63B 21/068 482/142 |
| 8,721,511 | B2 * | 5/2014 | Endelman | A63B 21/156 482/121 |
| 9,770,622 | B2 * | 9/2017 | Campanaro | A63B 22/0087 |
| 9,873,016 | B2 * | 1/2018 | Ellis | A63B 21/0615 |
| 10,220,247 | B2 * | 3/2019 | Ellis | A63B 21/225 |
| 2004/0209751 | A1 * | 10/2004 | Thonn, Jr. | A63B 21/00072 482/140 |
| 2006/0183606 | A1 * | 8/2006 | Parmater | A63B 22/0076 482/72 |
| 2011/0143888 | A1 * | 6/2011 | Chen | A63B 21/068 482/96 |
| 2013/0017935 | A1 * | 1/2013 | Endelman | A63B 21/023 482/131 |
| 2013/0324374 | A1 * | 12/2013 | Ellis | A63B 21/0615 482/97 |
| 2015/0367173 | A1 * | 12/2015 | Ellis | A63B 21/4047 482/127 |
| 2016/0107023 | A1 * | 4/2016 | Campanaro | A63B 22/0087 482/72 |
| 2018/0169463 | A1 * | 6/2018 | Ellis | A63B 21/225 |

* cited by examiner

LARGE MUSCLE EXERCISE MACHINE

The current application claims a priority to the U.S. Provisional Patent application Ser. No. 62/516,216 filed on Jun. 7, 2017.

FIELD OF THE INVENTION

The present invention relates generally to an exercise apparatus. More specifically, the present invention is an exercise apparatus that allow the user to focus on large muscle groups through resistance exercises.

BACKGROUND OF THE INVENTION

Gyms are the main facilities in which people go to get in shape and to be healthier through exercise. To some, gyms can be socially intimidating or require knowledge of complex to perform certain exercises. To others, there may not exist a desire motivation to drive to a gym and exercise. Regardless, exercise is an important aspect in maintaining a healthy lifestyle, strengthening muscles, or losing weight.

Therefore, an objective of the present invention is to provide an exercise machine that allows a user to focus on large muscle groups. The present invention is able to be utilized in comfort of the user's home. The present invention is designed for the user to execute a plurality of exercises, without the discomfort or risks to safety from free weights or exercise machines while doing squats, deadlifts, lunges, or similar exercises. The present invention utilizes resistance to the user's manipulation of a first handle and a second handle to allow the user to effectively perform the desired exercise. The present invention is collapsible to allow the user to store the present invention effectively in their home. Therefore, using the present invention, the user is able to exercise and improve large muscle groups from the comfort of the user's home.

DETAIL DESCRIPTIONS OF THE INVENTION

Figure 1:
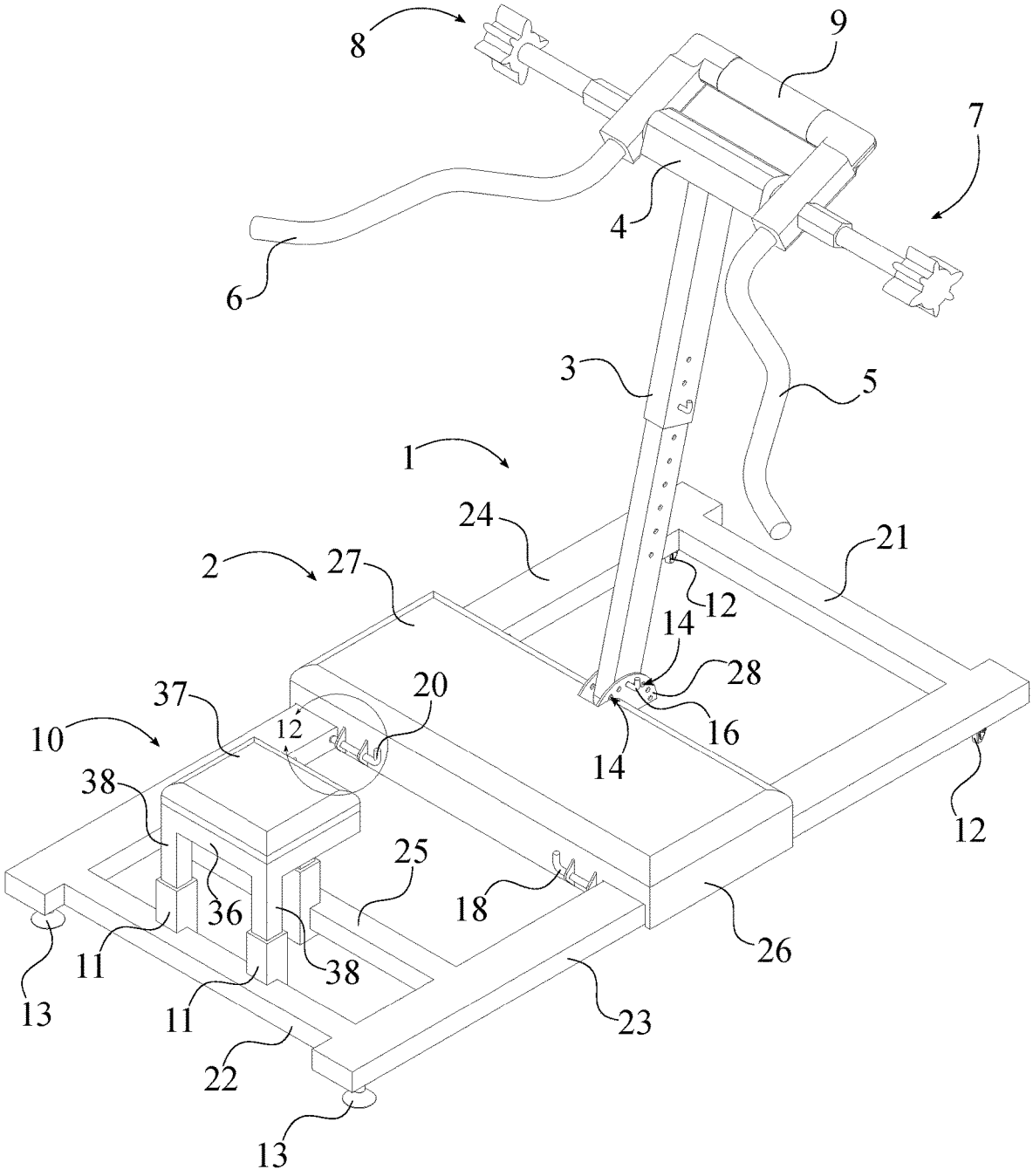
FIG. 1 is a rear, left perspective view of the present invention.
Figure 2:
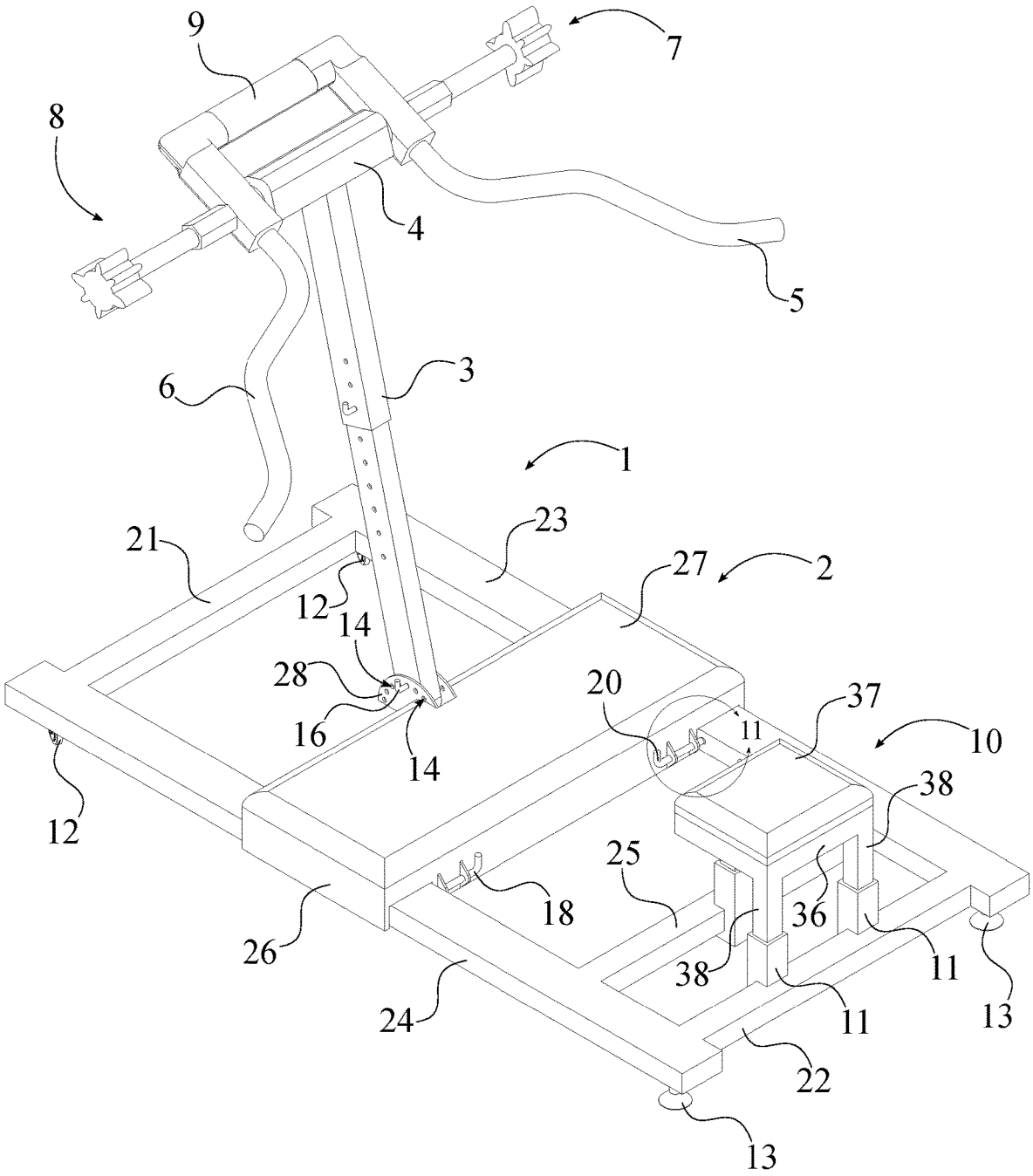
FIG. 2 is a rear, right perspective view of the present invention.

All illustrations of the drawings are for the purpose of describing selected versions of the present invention and are not intended to limit the scope of the present invention.

The present invention is a large muscle exercise machine. The present invention allows the user to effectively engage in exercise to improve or maintain a healthy life style. The present invention utilizes resistance to increase the effectiveness for a plurality of exercises during implementation of the present invention. The plurality of exercises targets specific muscle groups that include, but are not limited to, gluteus, quadricep, back, shoulder, chest, abdominal, biceps, triceps, or forearm muscles.

In accordance to FIG. 1 to FIG. 4, the present invention comprises a base frame 1, a support platform 2, a telescoping handlebar support 3, a handlebar 4, a first handle 5, a second handle 6, a first compression-adjustment mechanism 7, and a second compression-adjustment mechanism 8. The base frame 1 provides a structural foundation for the present invention on a horizontal surface, such as the ground or floor. The support platform 2 allows the telescoping handlebar support 3 to be mounted with the base frame 1, as well as, supporting the weight of the user during a plurality of exercises. The support platform 2 is slideably engaged along the base frame 1 to allow the user to adjust the position of the support platform 2 with respect to the desired exercise. The telescoping handlebar support 3 allows the user to adjust the height of the handlebar 4, and subsequently the first handle 5 and the second handle 6, to accommodate the height or reach of the user. The telescoping handlebar support 3 is adjacently and pivotably connected to the support platform 2. The handlebar 4 is a cross bar that mounts the first handle 5 and the second handle 6 to the telescoping handlebar support 3. The handlebar 4 is adjacently connected to the telescoping handlebar support 3. The handlebar 4 is oppositely positioned to the support platform 2 along the telescoping handlebar support 3, such that the first handle 5 and the second handle 6 are not obstructed by the base frame 1 during implementation. The first handle 5 and the second handle 6 are manipulated by the user to perform the desired exercise. The first handle 5 is rotatably mounted to the handlebar 4, through the first compression-adjustment mechanism 7. Similarly, the second handle 6 is rotatably mounted to the handlebar 4, through the second compression-adjustment mechanism 8. The first compression-adjustment mechanism 7 and the second compression-adjustment mechanism 8 provides a resistant force to the user's manipulation of the first handle 5 and the second handle 6 to increase the effectiveness of the desired exercise. The first handle 5 is oppositely positioned to the second handle 6, along the handlebar 4, such that the user is able to effectively engage the first handle 5 and the second handle 6 with each of the user's hands respectively to perform the desired exercise.

In accordance to the preferred embodiment of the present invention, the base frame 1 comprises a front strut 21, a rear strut 22, a first side strut 23 and a second side strut 24, which delineate the support structure, shown in FIG. 1 to FIG. 4, FIG. 7 and FIG. 8. The front strut 21 is adjacently connected to the first side strut 23. The second side strut 24 is adjacently connected to the front strut 21, opposite to the first side strut 23. The rear strut 22 is adjacently connected the second side strut 24, opposite to the first side strut 23. The first side strut 23 is oriented parallel to the second side strut 24. The front strut 21 is oriented parallel to the rear strut 22. This configuration provides a sturdy foundation to support the other components of the present invention as well as the user's weight during implementation of the present invention.

Figure 3:
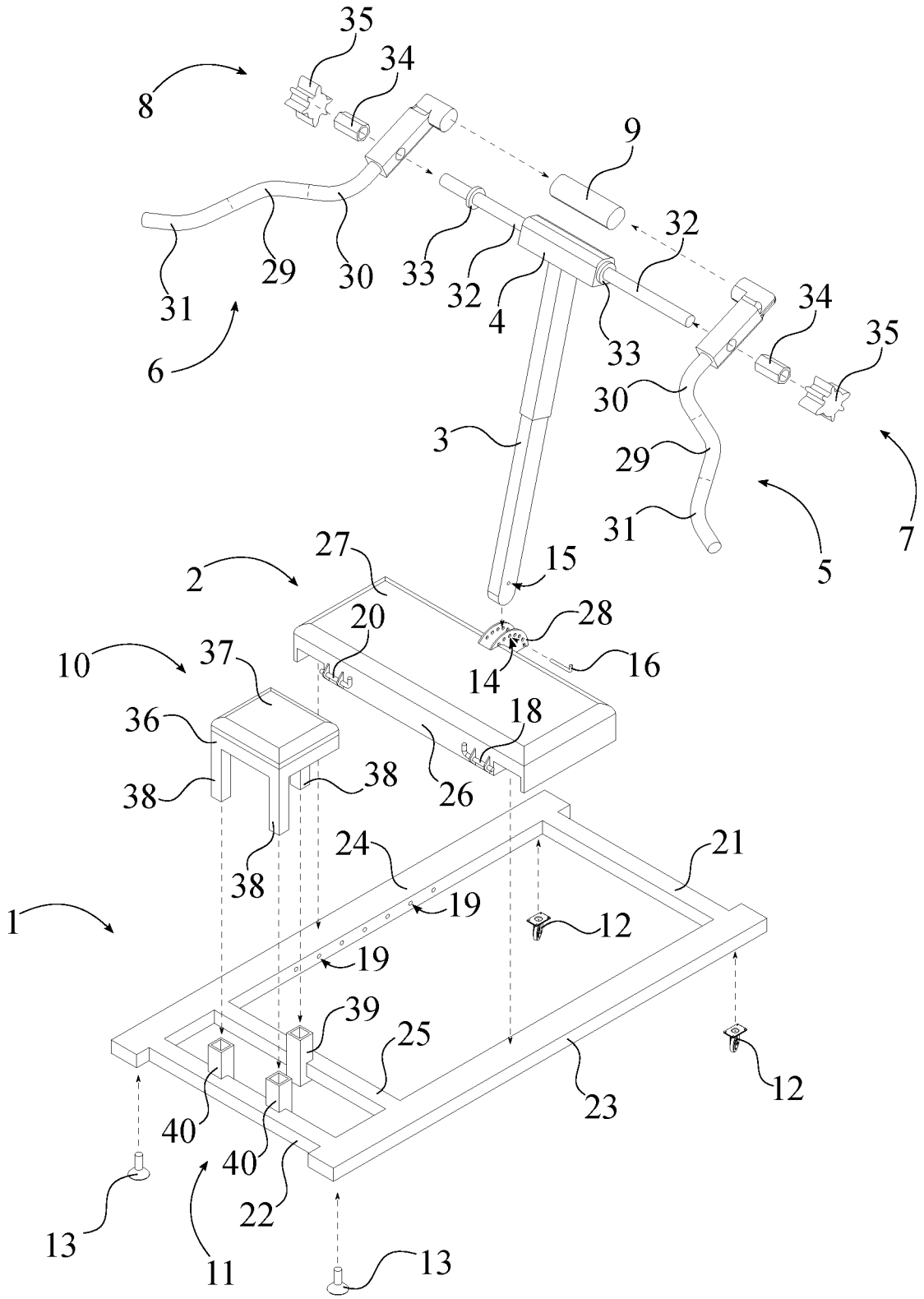
FIG. 3 is an exploded rear, left perspective view of the present invention.
Figure 4:
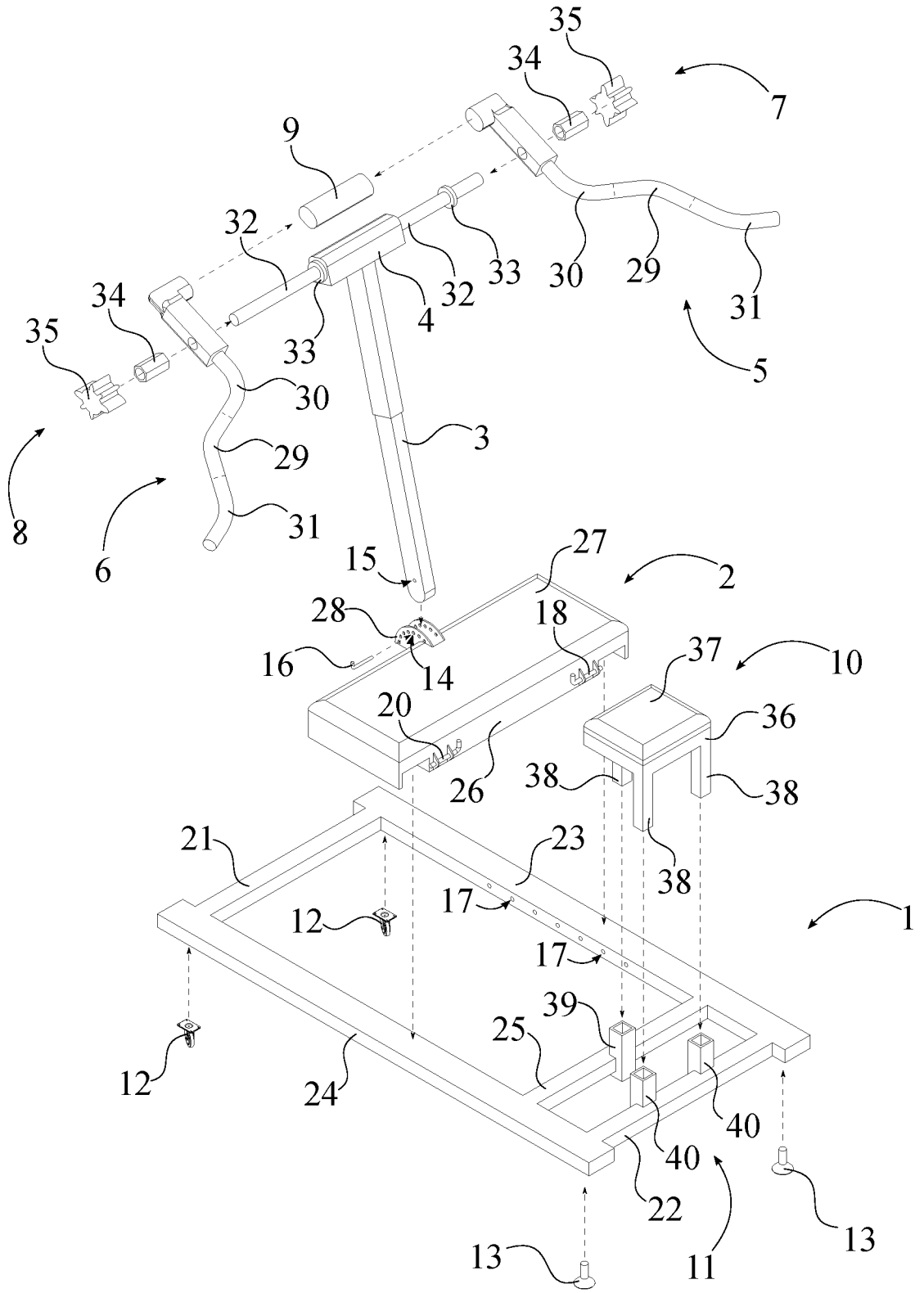
FIG. 4 is an exploded rear, right perspective view of the present invention.
Figure 5:
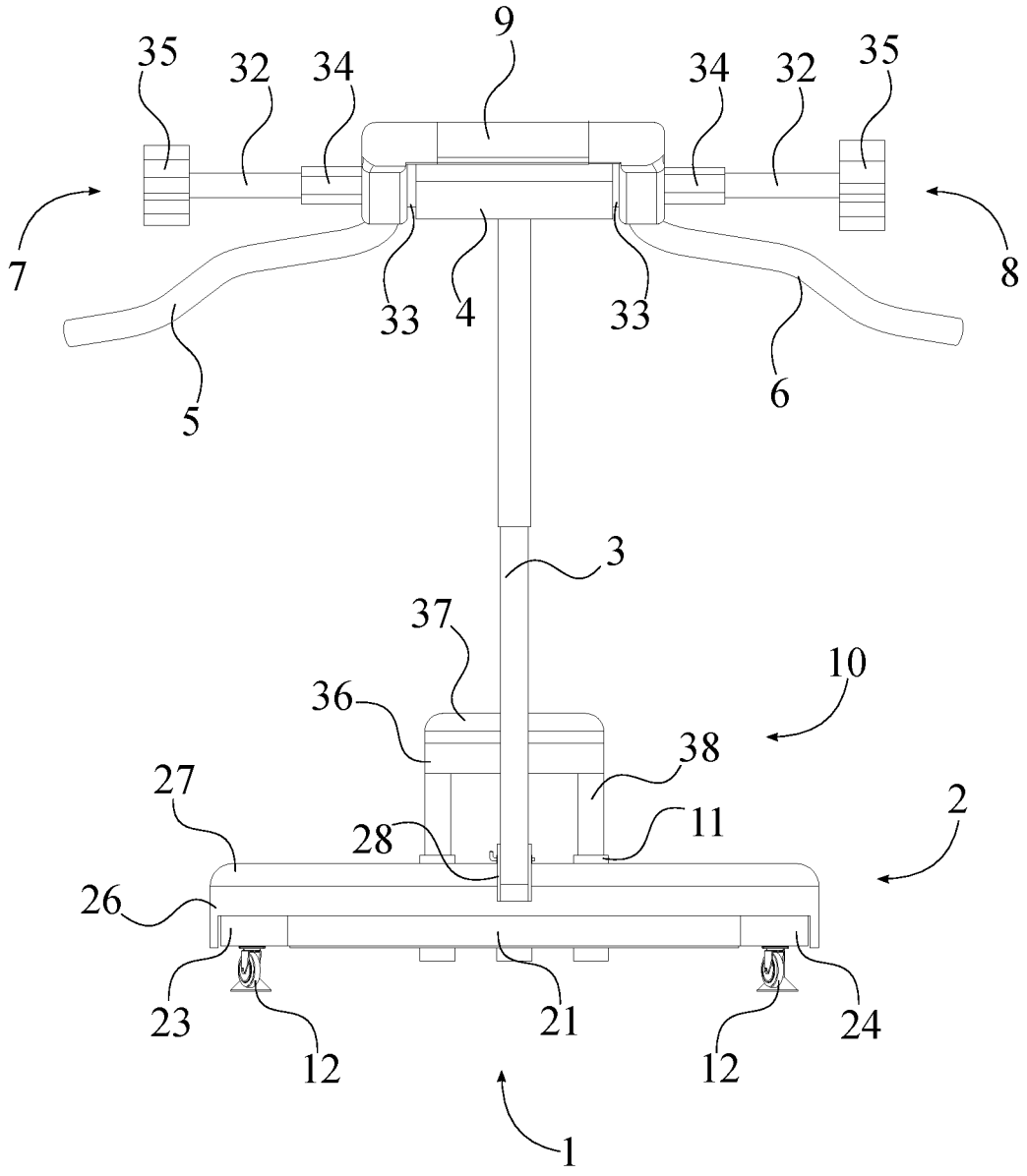
FIG. 5 is a front view of the present invention.
Figure 6:
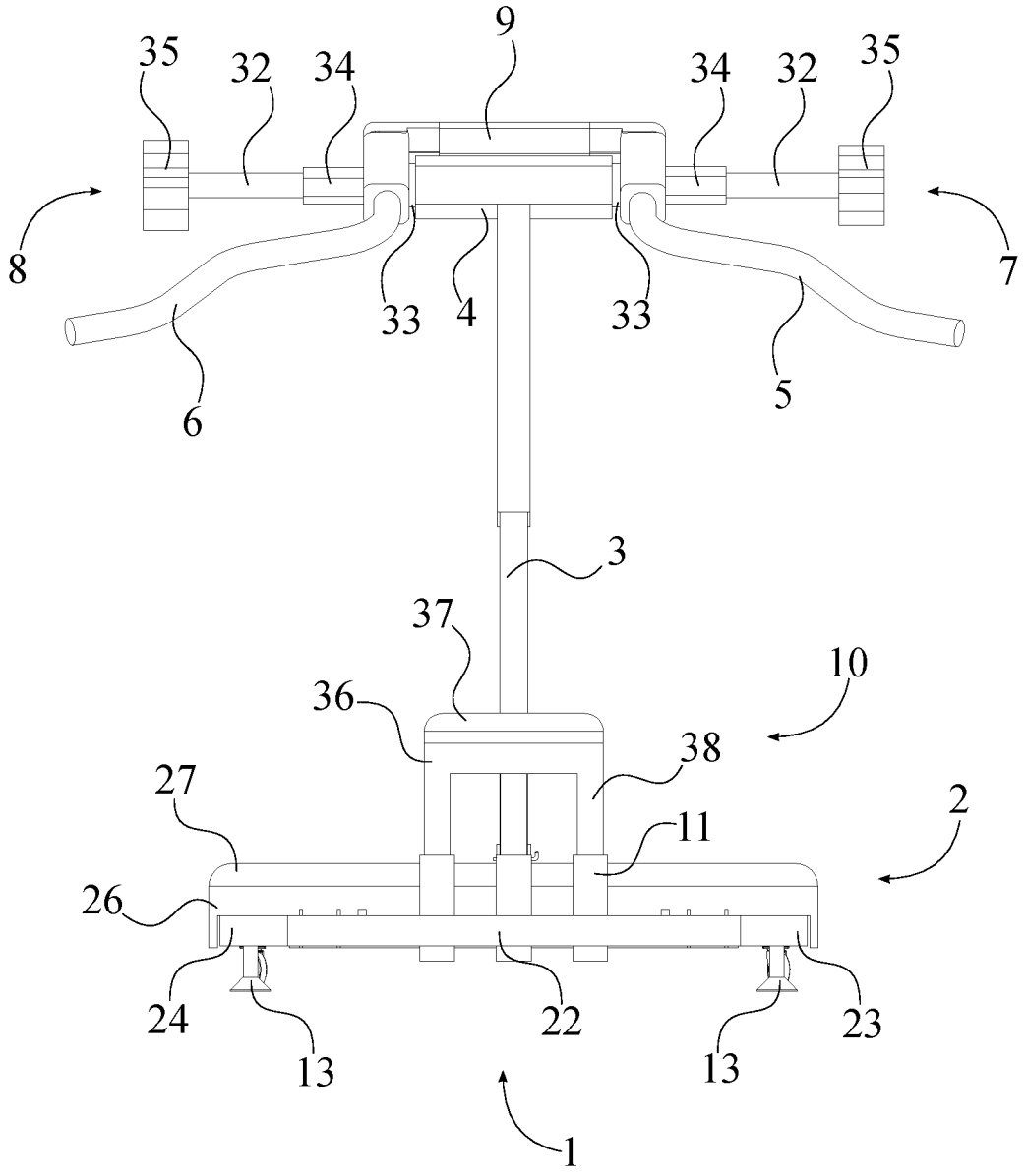
FIG. 6 is a front view of the present invention.
Figure 7:
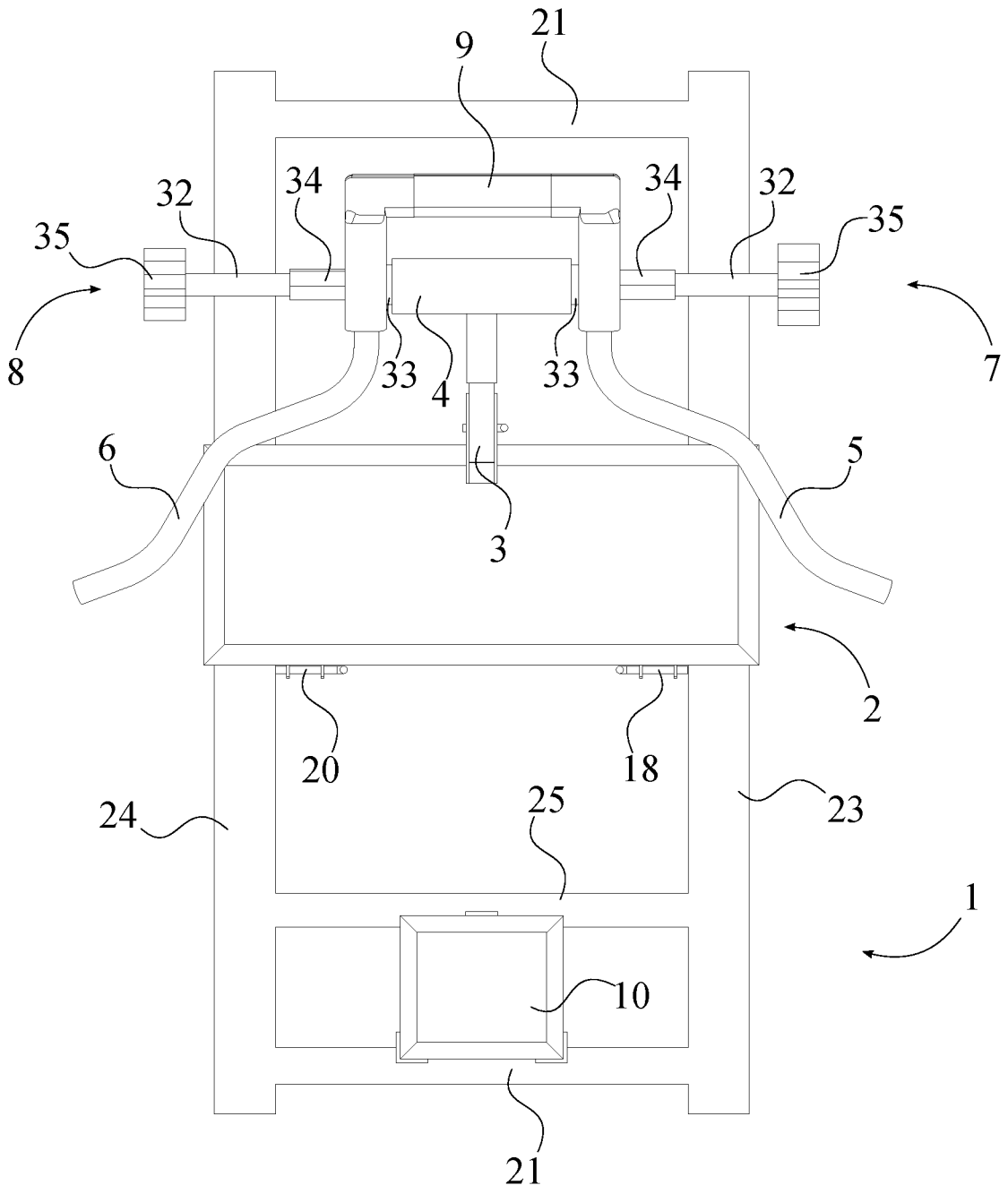
FIG. 7 is a top view of the present invention.

Further in accordance to the preferred embodiment of the present invention, the support platform 2 is slideably engaged with the first side strut 23, in accordance to FIG. 3 and FIG. 4. Similarly, the support platform 2 is slideably engaged with the second side strut 24. Therefore, the support platform 2 is able to translate along the base frame 1. The support platform 2 is positioned between the front strut 21 and the rear strut 22 to prevent the user from dislodging the support platform 2 accidentally.

In order for the first compression-adjustment mechanism 7 to increase the resistance for an exercise effectively, the first compression-adjustment mechanism 7 comprises a threaded shaft 32, a handlebar spacer 33, a compressing nut 34, and an actuation knob 35, detailed in FIG. 3 and FIG. 4. The threaded shaft 32 is adjacently connected to the handlebar 4. The threaded shaft 32 traverses through the first handle 5, the handlebar spacer 33, and the compressing nut 34, in order to support the first handle 5, the handlebar spacer 33, and the compressing nut 34. The first handle 5 is rotatably connected to the threaded shaft 32, to allow the user to rotate the first handle 5 to perform the desired exercise. The compressing nut 34 is threadedly connected to the threaded shaft 32. The actuation knob 35 being adjacently connected to the threaded shaft 32, opposite to the handlebar 4. In this configuration, the user adjusts the actuation knob 35 in order to apply or relieve pressure on the first handle 5 by driving the compressing nut 34 along the threaded shaft 32. The first compression-adjustment mechanism 7 provides push-pull resistance to engage push muscles and pull muscles independently as the user pushes or pulls on the first handle 5, respectfully.

Similarly, for the second compression-adjustment mechanism 8 to increase the resistance for an exercise effectively, the second compression-adjustment mechanism 8 comprises a threaded shaft 32, a handlebar spacer 33, a compressing nut 34, and an actuation knob 35, shown in FIG. 3 and FIG. 4. The threaded shaft 32 is adjacently connected to the handlebar 4. The threaded shaft 32 traverses through the second handle 6, the handlebar spacer 33, and the compressing nut 34, in order to support the second handle 6, the handlebar spacer 33, and the compressing nut 34. The second handle 6 is rotatably connected to the threaded shaft 32, to allow the user to rotate the second handle 6 to perform the desired exercise. The compressing nut 34 is threadedly connected to the threaded shaft 32. The actuation knob 35 being adjacently connected to the threaded shaft 32, opposite to the handlebar 4. In this configuration, the user adjusts the actuation knob 35 in order to apply or relieve pressure on the second handle 6 by driving the compressing nut 34 along the threaded shaft 32. The second compression-adjustment mechanism 8 provides push-pull resistance to engage push muscles and pull muscles independently as the user pushes or pulls on the second handle 6, respectfully.

In some embodiments of the present invention, the present invention comprises a handle coupling 9 in accordance to FIG. 1 to FIG. 7. The handle coupling 9 secures the first handle 5 with the second handle 6 such that the rotation of the first handle 5 rotates the second handle 6 equiangularly as the user manipulates the first handle 5 or vice versa. The handle coupling 9 is adjacently connected to the first handle 5. The handle coupling 9 is adjacently connected to the second handle 6. The first handle 5 is oppositely positioned to the second handle 6 along the handle coupling 9. The handle coupling 9 is offset from the handlebar 4. Thus, the angles of rotation for the first handle 5 and the second handle 6 are increased due to the collision of the handle coupling 9 with the telescoping handle-bar support opposed to the handle coupling 9 being adjacently positioned to the handlebar 4. This configuration allows the user to distribute exerted forces from the exercise evenly between the first handle 5 and the second handle 6 such that the user does not favor one side of the user's body for the exercise.

In accordance to the preferred embodiment of the present invention, the first handle 5 comprises a convex portion 29, a mounting concave portion 30, and a terminal concave portion 31, shown in FIG. 3 and FIG. 4. The convex portion 29, the mounting concave portion 30, and the terminal concave portion 31 provide the user with different grips along the first handle 5. The convex portion 29 is positioned between the mounting concave portion 30 and the terminal concave portion 31. The mounting concave portion 30 is mounted to the handlebar 4, through the first compression-adjustment mechanism 7, opposite to the convex portion 29. Therefore, the user is able to grasp the first handle 5 at the mounting concave portion 30, the convex portion 29 or the terminal concave portion 31, such that a decreasing amount of force, respectfully, is necessary to rotate the first handle 5 due to the differences in leverage from the user on the first handle 5.

Similarly, the second handle 6 comprises a convex portion 29, a mounting concave portion 30, and a terminal concave portion 31, detailed in FIG. 3 and FIG. 4. The convex portion 29, the mounting concave portion 30, and the terminal concave portion 31 provide the user with different grips along the second handle 6. The convex portion 29 is positioned between the mounting concave portion 30 and the terminal concave portion 31. The mounting concave portion 30 is mounted to the handlebar 4, through the second compression-adjustment mechanism 8, opposite to the convex portion 29. Therefore, the user is able to grasp the second handle 6 at the mounting concave portion 30, the convex portion 29 or the terminal concave portion 31, such that a decreasing amount of force, respectfully, is necessary to rotate the second handle 6 due to the differences in leverage from the user on the second handle 6.

Further in accordance to the preferred embodiment of the present invention, the present invention comprises a seat rest 10 and the base frame 1 further comprises a seat strut 25, detailed in FIG. 1 to FIG. 7, FIG. 9, and FIG. 10. The seat strut 25 and the rear strut 22 support the seat rest 10 on the base frame 1. The seat strut 25 is connected between the first side strut 23 and the second side strut 24. The seat strut 25 is positioned between the front strut 21 and the rear strut 22. The seat strut 25 is offset from the rear strut 22. The seat rest 10 supports the user's weight for exercises that benefit from being seated. The seat rest 10 is mounted to the rear strut 22 and the seat strut 25. The seat rest 10 is oriented parallel to the base frame 1, such that the user's weight is supported normal to the ground surface. In some embodiments of the present invention, the seat rest 10 comprises a seat base 36 and a padded cushion 37. The padded cushion 37 provides comfort to the user while the user is seated to perform the desired exercise. The seat base 36 is mounted to the rear strut 22 and the seat strut 25. The padded cushion 37 is adjacently connected to the seat base 36 opposite to the base frame 1.

Still in accordance to the preferred embodiment of the present invention, the present invention comprises a plurality of seat-receiving tubes 11, FIG. 1 to FIG. 6, FIG. 9, and FIG. 10. The plurality of seat-receiving tubes 11 supports the seat rest 10 onto the seat strut 25 and the rear strut 22, while allowing the seat to be easily removed for storage of the present invention. The seat rest 10 comprises a plurality of support legs 38 that are positioned within the plurality of seat-receiving tubes 11 to support the seat rest 10. The plurality of seat-receiving tubes 11 is hingedly connected to the base frame 1, such that the present invention is able to collapse to have a slimmer profile for storage. Each of the plurality of support legs 38 is slotted into a corresponding seat-receiving tube of the plurality of seat-receiving tubes 11 to support the seat rest 10 onto the base frame 1 during implementation of the present invention. In a more specific embodiment of the present invention, a first seat-receiving tube 39 of the plurality of seat-receiving tubes 11 is centrally positioned along the seat strut 25, detailed in FIG. 3 and FIG. 4. A pair of seat-receiving tubes 40 of the plurality of seat-receiving tubes 11 being centrally positioned along the rear strut 22. The pair of seat-receiving tubes 40 is positioned offset to each other. The first seat-receiving tube 39 and the pair of seat-receiving tubes 40 allow the weight of the seat rest 10 and the user to be distributed across the seat strut 25 and the rear strut 22. In a storage configuration, the first seat-receiving tube 39 and the pair of seat-receiving tubes 40 are oriented parallel to the seat strut 25 and the rear strut 22. The first seat-receiving tube 39 and the pair of seat-receiving tubes 40 are positioned between the seat strut 25 and the rear strut 22. In this configuration, the plurality of seat-receiving tubes 11 is positioned within the base frame 1 in order to compact the present invention for storage.

Figure 8:
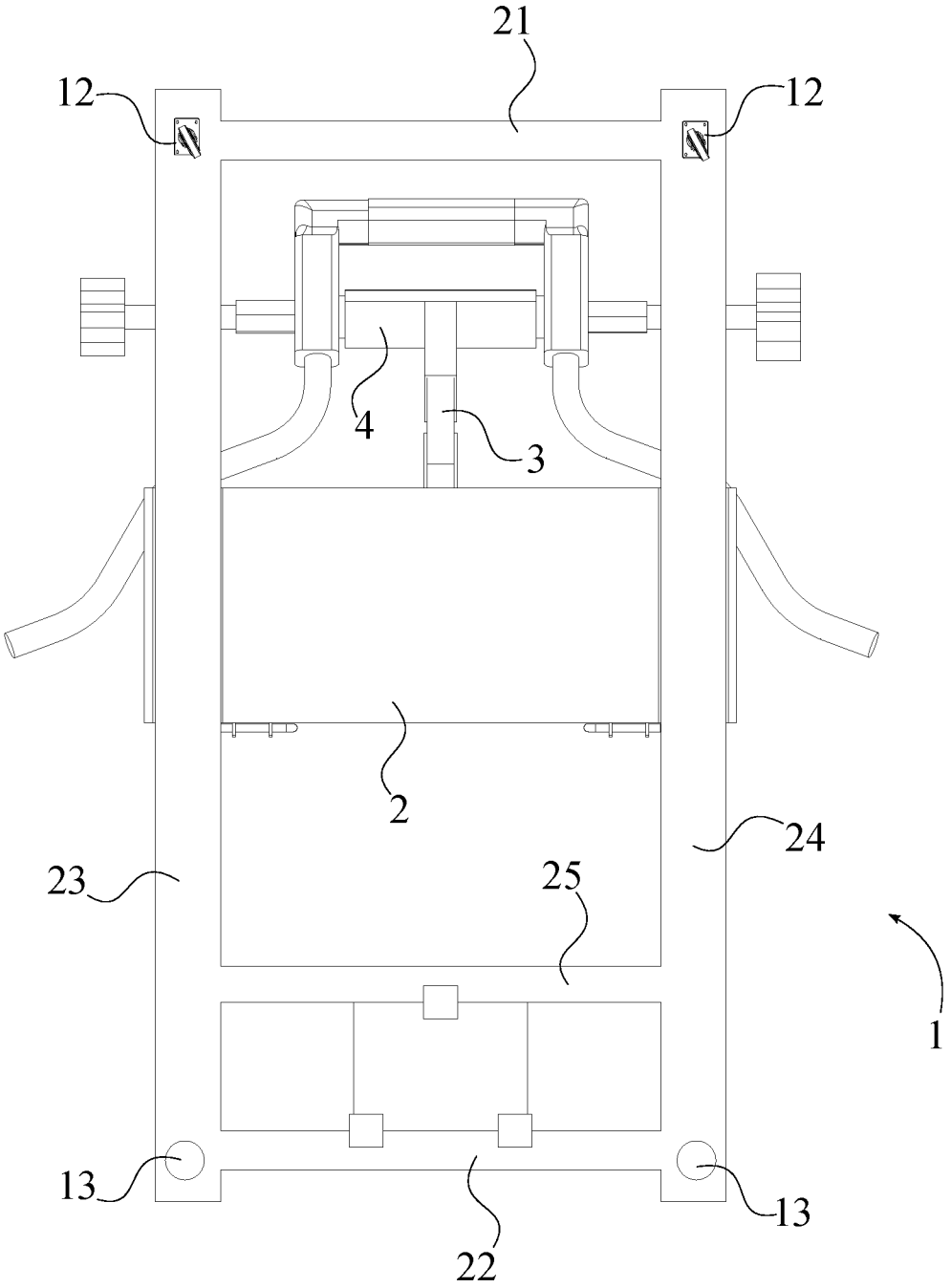
FIG. 8 is a front view of the present invention.
Figure 9:
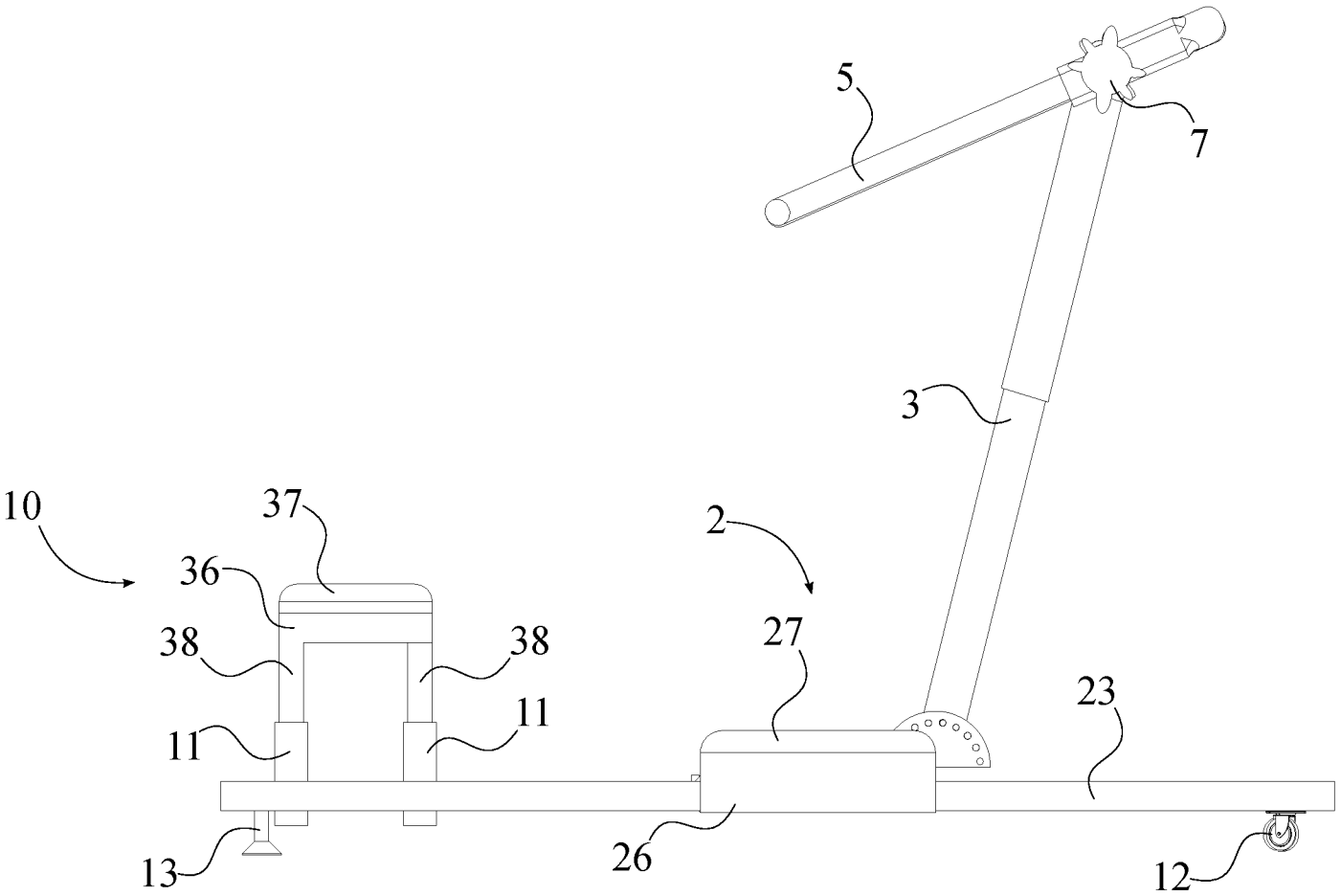
FIG. 9 is a left view of the present invention.
Figure 10:
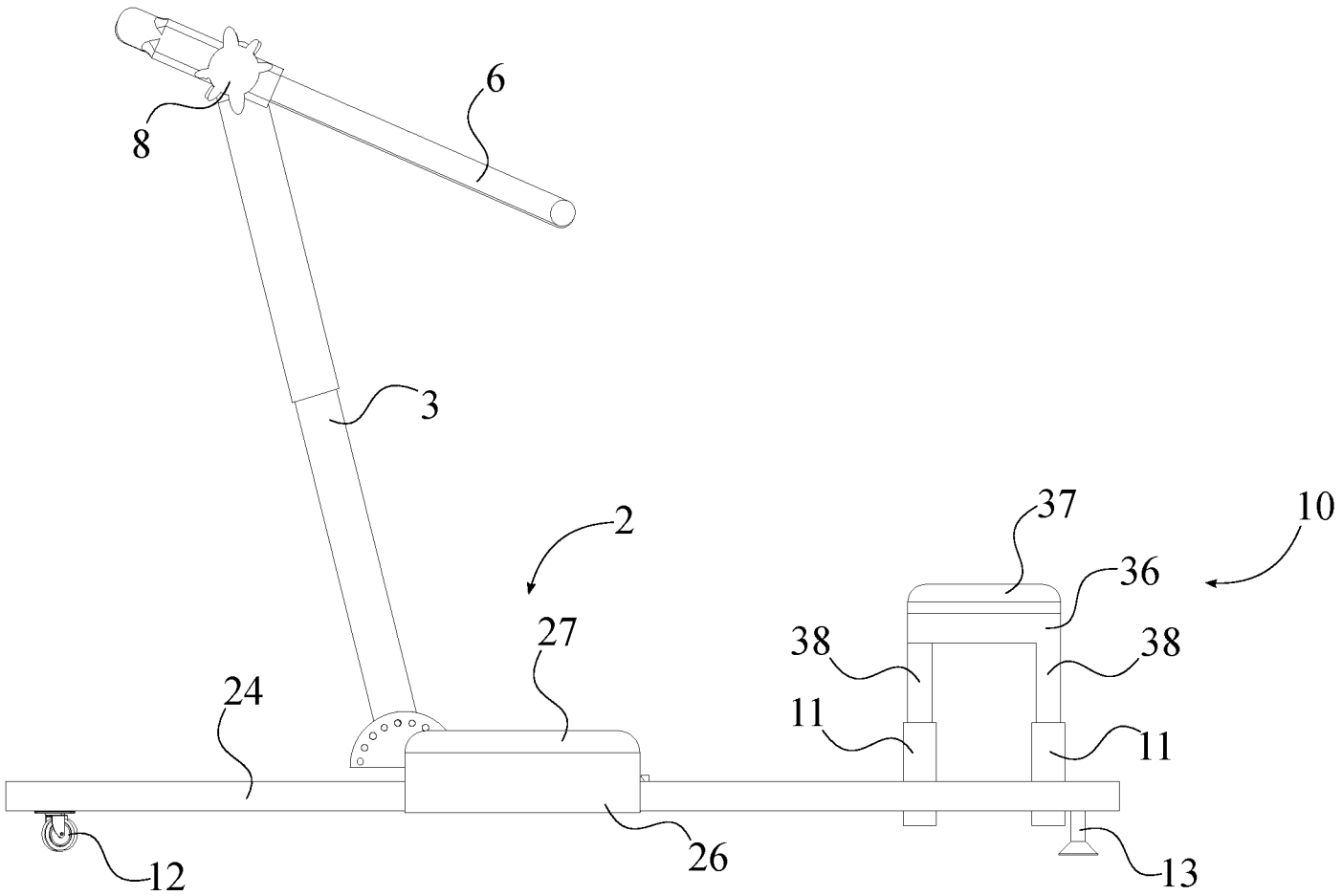
FIG. 10 is a right view of the present invention.

Still further in accordance to the preferred embodiment of the present invention, the present invention comprises a pair of casters 12 and a pair of leveling feet 13, detailed in FIG. 3, FIG. 4, and FIG. 8. The pair of casters 12 allow the user to move the present invention easily. The pair of casters 12 is adjacently connected to the base frame 1. The pair of leveling feet 13 allow the user to adjust the base frame 1 to become level with the ground surface. The pair of leveling feet 13 is adjustably connected to the base frame 1. The pair of leveling feet 13 is positioned opposite to the pair of casters 12 along the base frame 1, such that the user is able to lift the base frame 1 adjacent to the pair of leveling feet 13 to transport the present invention across the ground surface on the pair of casters 12. The pair of casters 12 and the pair of leveling feet 13 being oppositely oriented to the telescoping handlebar support 3, such that the base frame 1 is supported on the ground surface through the pair of casters 12 and the pair of leveling feet 13.

In accordance to the preferred embodiment, the support platform 2 comprises a sliding base 26, a kneepad 27, and an angular locking plate 28, shown in FIG. 3 and FIG. 4. The sliding base 26 being slideably engaged along the base frame 1, more specifically to the first side strut 23 and the second side strut 24, to translate the sliding base 26 along the base frame 1. The kneepad 27 provides a cushion for the user's knees as the user kneels to execute related exercises. The kneepad 27 is adjacently connected to the sliding base 26. The kneepad 27 is oppositely positioned base frame 1, such that the user is able to kneel on the kneepad 27 and effectively engage the first handle 5 and the second handle 6 to perform the desired exercise, detailed in FIG. 5 and FIG. 6. The angular locking plate 28 secures the telescoping handlebar support 3 at discrete angles to the support platform 2. The angular locking plate 28 is adjacently connected to the sliding base 26. The angular locking plate 28 is centrally positioned the sliding base 26, between the first side strut 23 and the second side strut 24. The angular locking plate 28 being positioned adjacent to the telescoping handlebar support 3.

More specifically, the present invention comprises a plurality of handlebar support locking holes 14, a handlebar support positioning hole 15 and a handlebar support locking pin 16 to secure the telescoping handlebar support 3 to the angular locking plate 28, in accordance to FIG. 3 and FIG. 4. The plurality of handlebar support locking holes 14 traverses through the angular locking plate 28. The plurality of handlebar support locking holes 14 is radially offset from the sliding base 26. The plurality of handlebar support locking holes 14 is angularly offset from each other, such that each locking hole is at a discrete angle to the sliding base 26. The handlebar support positioning hole 15 traverses through the telescoping handlebar support 3. The handlebar support positioning hole 15 is concentrically positioned with a locking hole of the plurality of handlebar support locking holes 14. The handlebar support locking pin 16 traverses through the locking hole and the handlebar support positioning hole 15 to prevent the rotation of the telescoping handlebar support 3 while the present invention is implemented.

Figure 11:
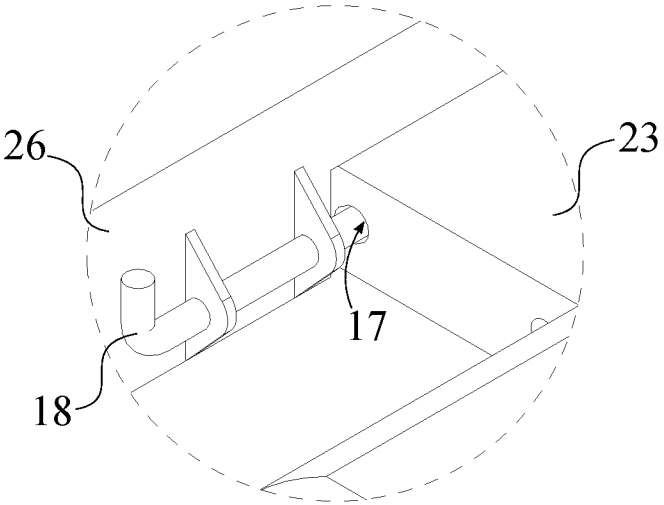
FIG. 11 is a detailed view of the first platform-locking pin for the present invention shown in FIG. 2.

In order to secure the support platform 2 to the base frame 1, the present invention comprises a first plurality of locking holes 17, and a first platform-locking pin 18, shown in FIG. 4, and FIG. 11, to prevent the support platform 2 from sliding while the user is attempting to execute an exercise. The first plurality of locking holes 17 traverse into the first side strut 23. The first plurality of locking holes 17 is offset from each other along the first side strut 23 to allow the support platform 2 to be positioned at discrete points along the first side strut 23. The first plurality of locking holes 17 is oriented towards the second side strut 24, to allow the first platform-locking pin 18 to align with each locking hole. The first platform-locking pin 18 is adjacently connected to the sliding base 26. The first platform-locking pin 18 engages a locking hole of the first plurality of locking holes 17 in order to secure the position of the support platform 2 along the base frame 1. The first platform-locking pin 18 may be spring loaded such that the user as the user slides the support platform 2 along the first side strut 23, the first platform-locking pin 18 engages the subsequent locking hole in the direction that the support platform 2 is being slid.

Figure 12:
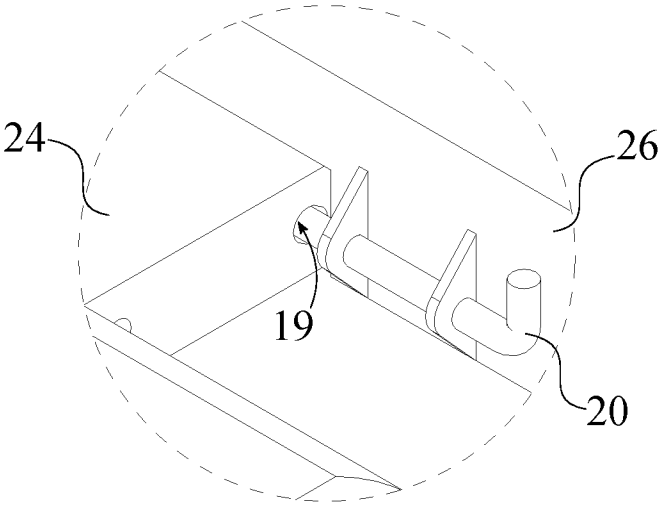
FIG. 12 is a detailed view of the first platform-locking pin for the present invention shown in FIG. 11.

To further secure the support platform 2 to the base frame 1, the present invention comprises a second plurality of locking holes 19 and a second platform-locking pin 20, detailed in FIG. 3, and FIG. 12, to prevent the support platform 2 from sliding while the user is attempting to execute an exercise. The second plurality of locking holes 19 traverse into the second side strut 24. The second plurality of locking holes 19 is offset from each other along the second side strut 24 to allow the support platform 2 to be positioned at discrete points along the second side strut 24. The second plurality of locking holes 19 is oriented towards the first side strut 23, to allow the second platform-locking pin 20 to align with each locking hole. The second platform-locking pin 20 is adjacently connected to the sliding base 26. The second platform-locking pin 20 engages a locking hole of the second plurality of locking holes 19 in order to secure the position of the support platform 2 along the base frame 1. The second platform-locking pin 20 may be spring loaded such that the user as the user slides the support platform 2 along the second side strut 24, the second platform-locking pin 20 engages the subsequent locking hole in the direction that the support platform 2 is being slid.

In implementation of the present invention, the user is able to execute a plurality of exercises utilizing the present invention. The plurality of exercises includes, but are not limited to overhead shoulder press, bicep curls, tricep pull-downs, or squats. The user adjusts the position of the support base by removing the first platform-locking pin 18 and the second platform-locking pin 20 from the locking hole of the first plurality of locking holes 17 and the locking hole of the second plurality of locking holes 19 respectively. The user then slides the support base into position according to their preference for the desired exercise and positions the first platform-locking pin 18 and the second platform-locking pin 20 into a corresponding locking hole of the first plurality of locking holes 17 and a corresponding locking hole of the second plurality of locking holes 19, respectfully. The user then adjusts the height of the handle bar with the telescoping pole in accordance to the desired exercise. The user subsequently adjusts the pressure on the first handle 5 with the first compression-adjustment mechanism 7 and adjusts the pressure on the second handle 6 with the second compression-adjustment mechanism 8 to an appropriate resistance for the desired exercise. The user then rotates the first handle 5 and the second handle 6 independently or simultaneously to execute the desire exercise.

Although the invention has been explained in relation to its preferred embodiment, it is to be understood that many other possible modifications and variations can be made without departing from the spirit and scope of the invention as hereinafter claimed.

What is claimed is:

1. A large muscle exercise machine comprises:
a base frame;
a support platform;
a telescoping handlebar support;
a handlebar;
a first handle;
a second handle;
a first compression-adjustment mechanism;
a second compression-adjustment mechanism;
the support platform being slideably engaged along the base frame;
the telescoping handlebar support being adjacently and pivotably connected to the support platform;
the handlebar being adjacently connected to the telescoping handle-bar support;
the handlebar being oppositely positioned to the support platform along the telescoping handlebar support;
the first handle being rotatably mounted to the handlebar, through the first compression adjustment mechanism;
the second handle being rotatably mounted to the handlebar, through the second compression adjustment mechanism; and
the first handle being oppositely positioned to the second handle, along the handlebar.

2. The large muscle exercise machine, as claimed in claim 1, comprises:
the base frame comprising a front strut, a rear strut, a first side strut, and a second side strut;
the front strut being adjacently connected to the first side strut;
the second side strut being adjacently connected to the front strut, opposite to the first side strut;
the rear strut being adjacently connected the second side strut, opposite to the first side strut; and
the first side strut being oriented parallel to the second side strut.

3. The large muscle exercise machine, as claimed in claim 2, comprises:
the support platform being slideably engaged with the first side strut;
the support platform being slideably engaged with the second side strut; and
the support platform being positioned between the front strut and the rear strut.

4. The large muscle exercise machine, as claimed in claim 1, comprises:
the first compression-adjustment mechanism comprising a threaded shaft, a handlebar spacer, a compressing nut, and an actuation knob;
the threaded shaft being adjacently connected to the handlebar;
the threaded shaft traversing through the first handle, the handlebar spacer, and the compressing nut;
the first handle being rotatably connected to the threaded shaft;
the compressing nut being threadedly connected to the threaded shaft; and
the actuation knob being adjacently connected to the threaded shaft, opposite to the handle bar.

5. The large muscle exercise machine, as claimed in claim 1, comprises:
the second compression-adjustment mechanism comprising a threaded shaft, a handlebar spacer, a compressing nut, and an actuation knob;
the threaded shaft being adjacently connected to the handlebar;
the threaded shaft traversing through the second handle, the handlebar spacer, and the compressing nut;
the second handle being rotatably connected to the threaded shaft;
the compressing nut being threadedly connected to the threaded shaft; and
the actuation knob being adjacently connected to the threaded shaft, opposite to the handle bar.

6. The large muscle exercise machine, as claimed in claim 1, comprises:
a handle coupling;
the handle coupling being adjacently connected to the first handle;
the handle coupling being adjacently connected to the second handle;
the first handle being oppositely positioned to the second handle along the handle coupling; and
the handle coupling being offset from the handle bar.

7. The large muscle exercise machine, as claimed in claim 1, comprises:
the first handle comprising a convex portion, a mounting concave portion, and a terminal concave portion;
the convex portion being positioned between the mounting concave portion and the terminal concave portion; and
the mounting concave portion being mounted to the handlebar, through the first compression-adjustment mechanism, opposite to the convex portion.

8. The large muscle exercise machine, as claimed in claim 1, comprises:
the second handle comprising a convex portion, a mounting concave portion, and a terminal concave portion;
the convex portion being positioned between the mounting concave portion and the terminal concave portion; and
the mounting concave portion being mounted to the handlebar, through the second compression-adjustment mechanism, opposite to the convex portion.

9. The large muscle exercise machine, as claimed in claim 1, comprises:
a seat rest;
the base frame comprising a front strut, a rear strut, a first side strut, a second side strut, and a seat strut;
the seat strut being connected between the first side strut and the second side strut;
the seat strut being positioned between the front strut and the rear strut;
the seat strut being offset from the rear strut;
the seat rest being mounted to the rear strut and the seat strut; and
the seat rest being oriented parallel to the base frame.

10. The large muscle exercise machine, as claimed in claim 9, comprises:

the seat rest comprising a seat base and a padded cushion;

the seat base being mounted to the rear strut and the seat strut; and the padded cushion being adjacently connected to the seat base opposite to the base frame.

11. The large muscle exercise machine, as claimed in claim 9, comprises:

a plurality of seat receivers;

the seat rest comprising a plurality of support legs;

the plurality of seat receivers being hingedly connected to the base frame; and each of the plurality of support legs being slotted into a corresponding seat receiver of the plurality of seat receivers.

12. The large muscle exercise machine, as claimed in claim 11, comprises:

a first seat receiver of the plurality of seat receivers being centrally positioned along the seat strut.

13. The large muscle exercise machine, as claimed in claim 11, comprises:

a pair of seat receivers of the plurality of seat receivers being centrally positioned along the rear strut; and the pair of seat receivers being offset from each other.

14. The large muscle exercise machine, as claimed in claim 1, comprises:

a pair of casters;

a pair of leveling feet;

the pair of casters being adjacently connected to the base frame;

the pair of leveling feet being adjustably connected to the base frame;

the pair of leveling feet being positioned opposite to the pair of casters along the base frame; and the pair of casters and the pair of leveling feet being oppositely oriented to the telescoping handlebar support.

15. The large muscle exercise machine, as claimed in claim 1, comprises:

the base frame comprising a first side strut and a second side strut;

the support platform comprising a sliding base, a kneepad, and an angular locking plate;

the sliding base being slideably engaged along the base frame;

the kneepad being adjacently connected to the sliding base;

the kneepad being oppositely positioned base frame;

the angular locking plate being adjacently connected to the sliding base;

the angular locking plate being centrally positioned the sliding plate, between the first side strut and the second side strut; and the angular locking plate being positioned adjacent to the telescoping handlebar support.

16. The large muscle exercise machine, as claimed in claim 15, comprises:

a plurality of handlebar support locking holes;

a handlebar support positioning hole;

a handlebar support locking pin;

the plurality of handlebar support locking holes traversing through the angular locking plate;

the plurality of handlebar support locking holes being radially offset from the sliding base;

the plurality of handlebar support locking holes being angularly offset from each other;

the handlebar support positioning hole traversing through the telescoping handlebar support; and the handlebar support locking pin traversing through a locking hole of the plurality of handlebar support locking holes and the handlebar support positioning hole.

17. The large muscle exercise machine, as claimed in claim 15, comprises:

a first plurality of locking holes;

a first platform-locking pin;

the first plurality of locking holes traversing into the first side strut;

the first plurality of locking holes being offset from each other along the first side strut;

the first plurality of locking holes being oriented towards the second side strut;

the first platform-locking pin being adjacently connected to the sliding base; and the first platform-locking pin engaging a locking hole of the first plurality of locking holes.

18. The large muscle exercise machine, as claimed in claim 15, comprises:

a second plurality of locking holes;

a second platform-locking pin;

the second plurality of locking holes traversing into the second side strut;

the second plurality of locking holes being offset from each other along the second side strut;

the second plurality of locking holes being oriented towards the first side strut;

the second platform-locking pin being adjacently connected to the sliding base; and the second platform-locking pin engaging a locking hole of the second plurality of locking holes.

* * * * *